US005377747A

United States Patent [19]

Didier

[11] Patent Number: 5,377,747

[45] Date of Patent: Jan. 3, 1995

[54] ENVIRONMENTALLY SAFE WELLHEAD

[75] Inventor: Robert G. Didier, Santa Rosa, Calif.

[73] Assignee: BIW Connector Systems, Inc., Norwood, Mass.

[21] Appl. No.: 104,647

[22] Filed: Aug. 11, 1993

[51] Int. Cl.[6] ..... E21B 33/10

[52] U.S. Cl. ..... 166/65.1; 439/660

[58] Field of Search ..... 166/65.1, 75.1; 439/660, 736

[56] References Cited

U.S. PATENT DOCUMENTS

| | | | |
|---|---|---|---|
| 4,458,903 | 7/1984 | Tohill | 166/75.1 X |
| 4,600,054 | 7/1986 | Miller et al. | 166/75.1 |
| 4,627,490 | 12/1986 | Moore | 166/65.1 |
| 4,685,758 | 8/1987 | Yoshida | 439/606 |
| 4,708,201 | 11/1987 | Reed | 166/65.1 |
| 5,108,317 | 4/1992 | Beinhaur et al. | 439/736 |
| 5,289,882 | 3/1994 | Moore | 166/65.1 X |

*Primary Examiner*—William P. Neuder

*Attorney, Agent, or Firm*—Kenway & Crowley

[57] ABSTRACT

An environmentally safe wellhead for wells utilizing electrical submersible pumps which includes an internally tapered casing head into which an externally tapered tubing hanger is closely fitted and sealed. Openings are formed through the tubing hanger parallel to its axis and production tubing is threaded into one of the openings. The power cable for the pump is enclosed in a feedthrough connector disposed and sealed in another of the openings. Tightly fitted metal parts are used and O-ring seals are disposed between the tapered walls of the casing head and hanger as well as between the wall of the opening and the feedthrough connector for the power cable. The feedthrough connector has a metal shell and a separable threadably connected cap member, the interior of which is substantially filled with resilient high dielectric constant material bonded to insulating layers disposed on contacts for the conductors of the cable.

10 Claims, 3 Drawing Sheets

ENVIRONMENTALLY SAFE WELLHEAD

This invention relates in general to wellheads for oil wells and more particularly to those in which electrical connectors for submersible pumps are used.

BACKGROUND OF THE INVENTION

In oil wells which utilize electrical submersible pumps, it is common practice to employ low-pressure wellheads rated under 3,000 psi. They rely upon rubber packing glands to effect seals around the production tubing and the power cable. Where a seal is used between production tubing of a given diameter and power cable of different diameter to seal against the inside of the wellhead body, rubber glands are not effective against fluid pressures within the wellhead.

Nevertheless, these relatively low-pressure wellheads are popular in the industry because they are adequate when used with electrical submersible pumps; they are relatively inexpensive; and few metal parts are needed. Furthermore, the assembly is relatively easily installed because the production tubing and the electrical power cable can and do come directly out of the well without being mechanically sealed or secured to the wellhead.

Although, as noted, wellheads of the type continue to be quite widely used, there are certain problems which arise. One of these problems arises from the use of rubber, when it is relied upon for long-term sealing. The actual procedure for achieving the seal involves the squeezing of the rubber of the gland to force it against different diameters of tubing and cable. With such geometry, effective seals to the wellhead body, and against both tubing and cable, are difficult to achieve. In fact, maintenance of a low-pressure seal of about 500 psi is about the limit of effectiveness. Other problems also are encountered from the use of rubber for long-term protection. Gas is always present in oil wells, and rubber is particularly vulnerable to the gas which attacks the underside of the rubber and ultimately results in gas leakage as the rubber breaks down. The top side of the rubber, being exposed to the weather, is also subject to breakdown followed by gas leakage. The gas problem is aggravated further by the drilling of adjacent new wells and by the employment of water flooding to increase oil recovery. In the case of adjacent new drilling, high-pressure gas may be released through the formation and creates a safety hazard, and water flooding leads to an increased concentration of hydrogen sulfide gas from which the rubber packing is particularly susceptible to damage. Finally, the electrical cable is usually sealed only on its outer surface to the wellhead and gas may continuously escape through the wellhead by passing inside the cable jacket. Such passage of gas also occurs through the interior of electrical connectors now in use. These generally consist of an assembly of parts about the ends of the cable being used to carry power to the submersible pump. Gas under high pressure from the wellhead tends to force its way through the body of the electrical connector and presents a serious hazard in the form of an explosive atmosphere about the wellhead.

The present invention is concerned with the solution of the problems outlined. The primary object of the invention is a seal which not only withstands full pressure, but which also renders the wellhead environmentally safe. A further object of the present invention is a seal which meets all standards of the National Electric Code. A still further object of the invention is a seal in which all critical elements are made of tight-fitting metal parts resulting in long life and the absence of gas leakage. Yet another object is an explosion-proof connector which is intrinsically safe electrically.

SUMMARY OF THE INVENTION

The foregoing objects are achieved in the present invention first by eliminating large rubber glands and providing shaped metal members combined with multiple seal rings to assure effective sealing. The conventional slips and rubber packing widely used in current wellheads are eliminated. Instead, a metal tubing hanger having a tapered exterior which matches a cooperating taper formed on the inside of the casing head is used. The tubing hanger has openings formed parallel to its axis to accommodate production tubing and a feedthrough cable connector. Several seal rings are used to effect seals between the tubing hanger and the wellhead, and between the feedthrough cable connector and the walls of the opening formed through the hanger.

The feedthrough cable connector is an integral assembly sealed to input and output lengths of cable. It includes a high-pressure seal comprised of a solid body of resilient high dielectric insulation substantially filling an outer shell and enclosing sleeve contacts into which contact pins fixed to conductors of the cable are inserted. The sleeve contacts are provided with insulating layers of cable dielectric quality which are bonded to the dielectric body which substantially fills the shell. The shell has a shoulder which seats against the Lower surface of the tubing hanger and has a body which passes upwardly through the opening in the tubing hanger. After a pigtail of the factory-attached output cable is spliced to the downhole cable, the connector body is inserted upwardly through the tubing hanger. An upper connector housing cap member is then tightened on the feedthrough body and bears on the upper surface of the tubing hangar to secure the body firmly in place. Multiple metal-to-metal or rubber O-ring seals or combinations thereof are also provided between the outer wall of the feedthrough connector and the tubing hanger. For a better understanding of the present invention, together with other and further objects, features, and advantages, reference should be made to the following description of a preferred embodiment which should be read with reference to the appended drawing in which:

DETAILED DESCRIPTION OF PREFERRED EMBODIMENT

Figure 1:
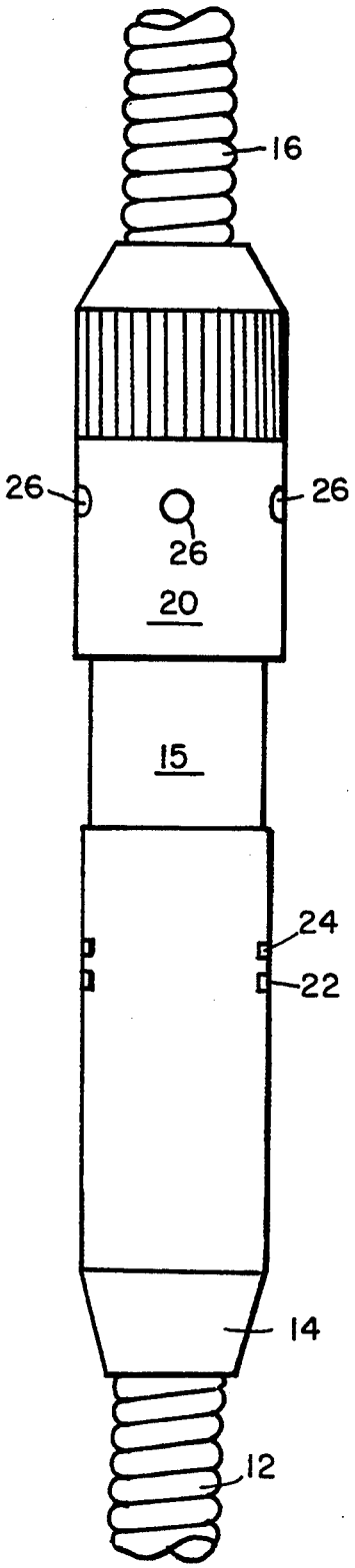
FIG. 1 is an outline drawing of the exterior of the feedthrough connector of the invention.

FIG. 1 illustrates the exterior outline of the explosion-proof electrical feedthrough connector substantially as it is shipped from the factory. The connector is an integral sealed assembly which includes a pigtail of input cable 16 and a pigtail of output cable 12. As will be apparent in subsequent views, these pigtails are sealed in the connector ends by molded rubber seal members, not visible in this view. One of the seal members has a tapered protective cover 14 which is fitted over the lower output end of the shell 15 of the feedthrough. The power input cable pigtail 16 is similarly sealed in a molded rubber member which is not visible in FIG. 1 because it is enclosed within an upper housing cap member 20. The cap member 20 (shown in greater detail in FIG. 2A) is not a part of the sealed assembly, but is screwed onto the upper end of the shell 15 of the feedthrough connector as a final step of assembly of the connector in the tubing hanger, as is explained in detail hereinafter.

Spaced peripheral seal grooves 22 and 24 are formed in the surface of the shell 15 to accommodate metal or rubber O-ring seals. These grooves may be formed in a straight cylindrical portion of the connector as shown or they may be formed in a tapered portion to match a similar tapered portion of the tubing hanger when such structure is adopted. Spaced shallow radial openings 26 are formed in the housing member 20 to accommodate a tightening tool, such as a spanner wrench, which may be utilized in the final tightening of the feedthrough in the tubing hanger.

Figure 2:
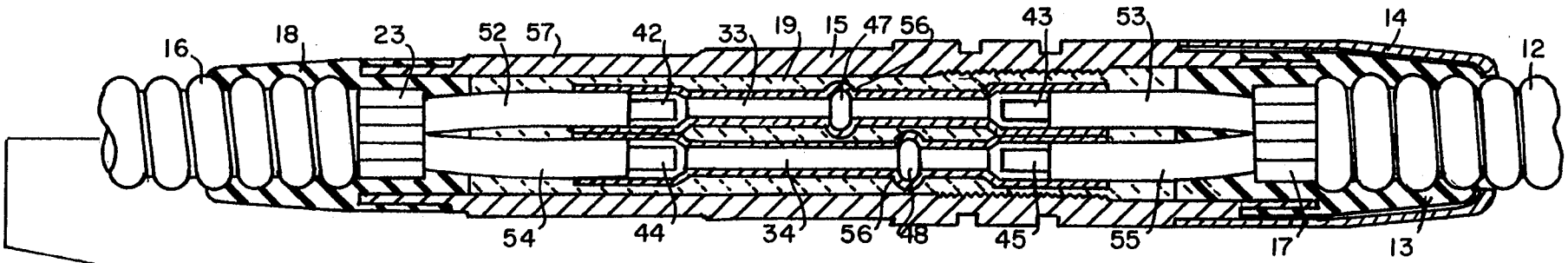
FIG. 2 is a drawing in section of a preferred form of the integrally sealed feedthrough connector showing internal elements.
Figure 2A:
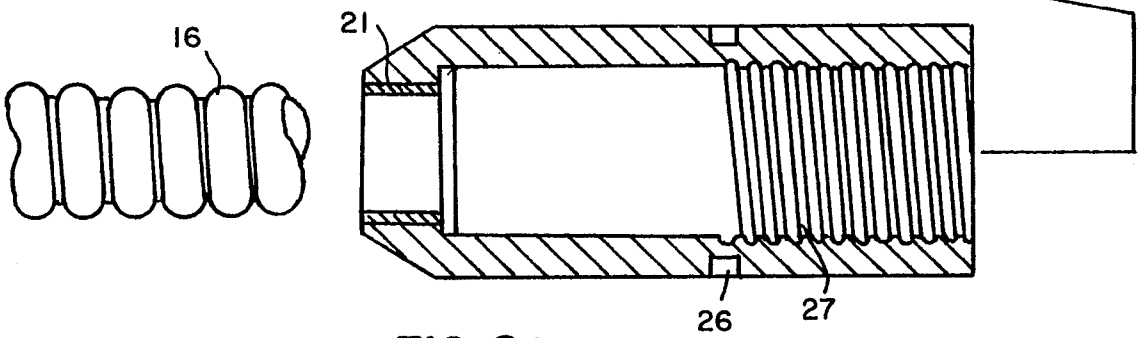
FIG. 2A is a view in section of the threaded housing cap member of the feedthrough connector.

The integral sealed nature of the connector having no separable parts is illustrated in FIG. 2. First, in a preliminary preparation, the body 19 of rigid high-pressure molded plastic is formed enclosing one-piece open-ended hollow contact members 32 and 34. The body 19 formed by potting, molding under high pressure, or other similar procedure. It is then screwed into the shell 15, the cable conductors are inserted, and the total assembly, including the cable ends 12 and 16 enclosed within the molded rubber sealing members 13 and 18 respectively, are molded together to produce the integral assembly shown in FIG. 2. The body 19 includes suspended rubber particles to improve its boning and sealing characteristics with the rubber end seals 13 and 18 as well as with the insulating layers on the hollow contact members.

The contact members 32 and 34 are formed from lengths of solid conductive metal having open ends to serve as sockets. They also include similar stepped central enlargements 47 and 48, respectively. The central enlargements, like the remainder of the contact members 32 and 34, are enclosed in layers of high dielectric constant insulation, which bonds to the rubber-loaded plastic body 19, forming an integral barrier substantially across the connector interior to block the flow of any hazardous fluids through the interior of the connector, as well as a mechanical step against high-pressure fluids acting on the cable 12.

The steel armor of the cables 12 and 16 is cut back to expose insulation jackets 17 and 23, respectively, which in turn are cut back to expose insulated individual conductors. A grounding sleeve 21 may be interposed between the housing member 20 and the armor of the cable pigtail 16 to assure good electrical conductivity between the feedthrough shell 15 and the grounded armor of the surface cable 16.

The open ends or sockets on the solid contact members 32 and 34 accommodate contact pins 42, 43, 44, and 45 respectively which are soldered or otherwise fixed to the ends of cable conductors 52, 53, 54, and 55.

Figure 3:
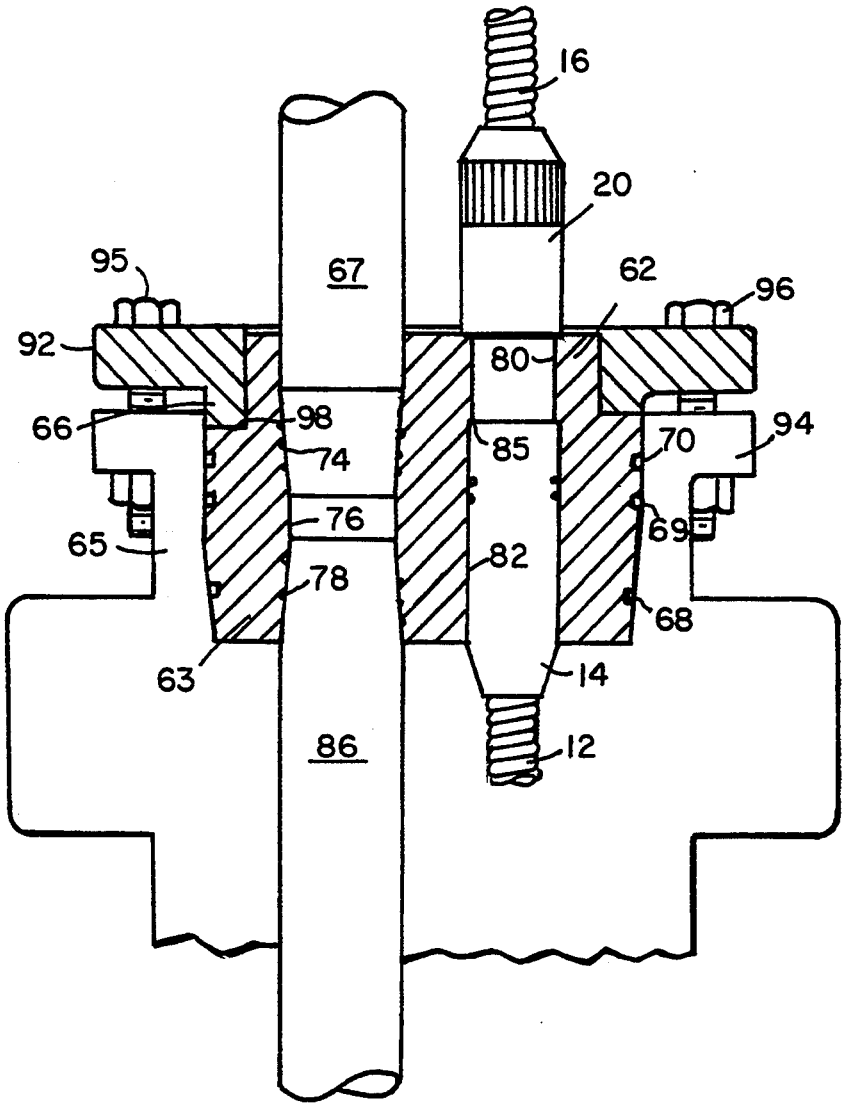
FIG. 3 is a drawing also partly in section of the assembled wellhead with the tubing hanger and feedthrough in place.

In FIG. 3, there may be seen a tubing hanger 62 made of metal compatible with that of the wellhead casing, such as ductile iron, and designed for insertion in the casing head 65. The lower portion 63 of the tubing hanger is constructed with a slight external taper matching the internal taper of the casing head. The top of the tubing hanger 62 has an area of reduced diameter forming an external shoulder 66. Peripheral seal grooves are formed in both the straight and tapered lower portions of the hanger to accommodate sealing rings of metal or rubber to effect a seal between the tubing hanger 62 and the body 65 of the casing head. Typical sealing rings are shown in the grooves 68, 69 and 70. Additional grooves may be formed in the upper cylindrical portion or the tapered portion of the hanger to accommodate additional ring seals.

Two openings are formed parallel to the axis vertically through the tubing hanger. The first, to accommodate output production tubing 67, includes a tapered threaded upper portion 74. There is also a cylindrical central portion 76 and a reverse tapered threaded portion 78. The topmost length of downhole production tubing 86 is threaded in the tapered opening 78 utilizing special sealing threads which block any flow of high-pressure fluids The output tubing 67 is similarly sealed in the tapered opening 78.

A second major opening formed axially through the tubing hanger accommodates the feedthrough for the electrical power cable. It includes an upper central cylindrical portion of reduced diameter 80 and a lower portion 82 of somewhat larger diameter. An internal shoulder 85 is formed at the junction of the portions 80 and 82.

After the topmost length of production tubing 86 is secured in the underside of the tubing hanger, the downhole cable is spliced to the pigtail 12, and the shell 15 of the electrical connector feedthrough is inserted upwardly through the tubing hanger from below. The upper housing member 20 is tightened by engagement of the internal threads onto the shell body 15 utilizing a tool such as a spanner wrench to engage the openings 26. The bottom surface of the member 20 bearing upon the top of the tubing hanger pulls the feedthrough against the internal shoulder 85 in the tubing hanger. The O-ring seals at 22 and 24 are compressed against the wall of the opening 82 in the tubing hanger and form an effective seal therewith.

A cover plate 92 having a collar 98 and a large central opening fitted over the top portion of reduced diameter of the tubing hanger is bolted to a flange 94 on the casing head 65. Bolts are spaced peripherally about the cover plate, the bolts 95 and 96 being visible in FIG. 3. When the bolts are tightened, they bring a cover plate collar 98 into bearing contact with the shoulder 66 formed by the top surface of the tubing hanger, applying sealing pressure between the hanger and the interior of the casing head.

Because all splicing may be completed before the installation of the electrical feedthrough from beneath the tubing hanger, the installation itself may be performed quickly and expeditiously. The design of the feedthrough is such that it is intrinsically safe electrically as well as explosion-proof.

What is claimed is:

1. In an environmentally safe wellhead having a tubing hanger for suspending production tubing and a feedthrough connector for a multi-conductor electrical cable in an oil well casing, the combination wherein said feedthrough connector comprises a metal shell, a body of solid insulating material of high dielectric constant disposed within said shell, insulated contact members for electrical connection to said conductors being sealed within said body, the insulation of said contact members being bonded to said body of solid insulating material of high dielectric constant, said hanger having first and second openings formed therethrough and peripheral grooves formed in the exterior wall thereof, O-rings being disposed in said grooves, and in sealing contact with said casing, said first opening accommodating said production tubing, and said second opening accommodating said feedthrough connector.

2. In an environmentally safe wellhead as defined in claim 1, the combination wherein said electrical connector includes a separable member and said second opening includes a downwardly facing internal shoulder formed on the interior wall thereof, said feedthrough connector having a complementary upwardly facing shoulder contacting said internal shoulder, said separable member being threadably connected to said connector and bearing upon the top surface of said tubing hanger, rotation of said separable member being adapted to draw said complementary shoulder of said feedthrough connector into intimate contact with said internal shoulder of said second opening, said feedthrough connector also having grooves formed in the periphery thereof, O-rings being disposed in said grooves in said feedthrough connector to form a seal between said feedthrough connector and the wall of said second opening.

3. In an environmentally safe wellhead as defined in claim 1, the combination wherein said first opening includes at least a threaded inner wall and said production tubing includes at least a similarly threaded end whereby said production tubing may be screwed into and supported from said tubing hanger.

4. In an environmentally safe wellhead as defined in claim 1, the combination wherein said means for urging said O-rings into sealing contact with said casing comprises a cover plate and tubing hanger and means connecting said cover plate to said casing for urging said tubing hanger into sealing contact with said casing.

5. An environmentally safe wellhead as defined in claim 4 wherein said casing includes an upper flange and said cover plate is substantially similar in shape to said upper flange, said means connecting said cover plate to said casing head comprising a spaced array of bolts disposed between said cover plate and said upper flange.

6. In an environmentally safe wellhead as defined in claim 1, the combination wherein said contact members include end sockets for receiving the ends of said conductors and are centrally disposed in said feedthrough connector, said contact members being surrounded by insulating material having insulating and dielectric qualities equivalent to those of said power cable.

7. In an environmentally safe wellhead as defined in claim 6, the combination wherein each of said contact members includes an enlarged central portion embedded in said solid body of high dielectric constant material, said enlarged central portions reinforcing resistance to fluid flow through said connector.

8. In an environmentally safe wellhead as defined in claim 7, the combination wherein said separable member bears upon a first surface of said tubing hanger and said connector has a shoulder formed on its outer wall, said shoulder bearing upon a second opposite surface of said tubing hanger, whereby tightening of said separable member threadably on said connector tightens said connector in said tubing hanger.

9. In an environmentally safe wellhead, an electrical connector comprising a housing shell, a molded plastic body substantially filling said shell, open-ended contact members sealed in said molded plastic, a cable sealed by a molded member in each end of said connector and having conductors inserted in said contact members, and layers of insulation surrounding said contact member, said molded plastic body being bonded to said molded members and to said layers of insulation.

10. In an environmentally safe wellhead as defined in claim 9, the combination wherein each of said open-ended contact members includes an enlargement, the total area of the enlargement of said contact members approximating the radial interior area of said housing shell.

* * * * *